US010400570B2

(12) United States Patent
Erge et al.

(10) Patent No.: US 10,400,570 B2
(45) Date of Patent: Sep. 3, 2019

(54) AUTOMATIC WELLBORE CONDITION INDICATOR AND MANAGER

(71) Applicant: Schlumberger Technology Corporation, Sugar land, TX (US)

(72) Inventors: Oney Erge, Houston, TX (US); James C. Brannigan, Cypress, TX (US); Wayne Kotovsky, Katy, TX (US); Ginger Hildebrand, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 571 days.

(21) Appl. No.: 14/538,672

(22) Filed: Nov. 11, 2014

(65) Prior Publication Data

US 2015/0134257 A1 May 14, 2015

Related U.S. Application Data

(60) Provisional application No. 61/903,419, filed on Nov. 13, 2013.

(51) Int. Cl.

| | |
|---|---|
| ***E21B 44/00*** | (2006.01) |
| ***E21B 47/00*** | (2012.01) |
| ***E21B 49/00*** | (2006.01) |

(52) U.S. Cl.

CPC ..... *E21B 44/00* (2013.01); *E21B 47/00* (2013.01); *E21B 49/003* (2013.01)

(58) Field of Classification Search

None

See application file for complete search history.

(56) References Cited

U.S. PATENT DOCUMENTS

| | | | | |
|---|---|---|---|---|
| 3,006,186 | A | 10/1961 | Berry et al. | |
| 3,085,428 | A | 4/1963 | Waddill et al. | |
| 3,268,003 | A | 8/1966 | Essary et al. | |
| 3,427,653 | A | 2/1969 | Jensen et al. | |
| 3,541,851 | A | 11/1970 | Youmans et al. | |
| 5,181,572 | A | 1/1993 | Andersen et al. | |
| 5,508,915 | A | 4/1996 | Tsao et al. | |
| 5,952,569 | A | 9/1999 | Jervis et al. | |
| 6,549,854 | B1 * | 4/2003 | Malinverno | G01V 1/282 367/73 |

(Continued)

FOREIGN PATENT DOCUMENTS

WO 2013/066746 5/2013

OTHER PUBLICATIONS

International search report and written opinion for the equivalent PCT patent application No. PCT/US2014/065141 dated Feb. 25, 2015.

(Continued)

*Primary Examiner* — Shaun M Campbell

(74) *Attorney, Agent, or Firm* — Alec J. McGinn

(57) ABSTRACT

A method for monitoring condition of a wellbore includes initializing a value of at least one parameter having a relationship to likelihood of a drill string becoming stuck in a wellbore (the HCF). During drilling operations, at least one drilling parameter having a determinable relationship to the HCF is measured. In a computer, the value of the HCF is recalculated based on the at least one measured parameter. The initial value of the HCF and the recalculated values of the HCF are displayed to a user.

33 Claims, 6 Drawing Sheets

(56) References Cited

U.S. PATENT DOCUMENTS

| | | | | |
|---|---|---|---|---|
| 7,059,427 | B2 | 6/2006 | Power et al. | |
| 7,878,254 | B2 | 2/2011 | Abdollahi et al. | |
| 2002/0103630 | A1* | 8/2002 | Aldred | E21B 44/00 703/10 |
| 2004/0124012 | A1 | 7/2004 | Dunlop et al. | |
| 2011/0153296 | A1* | 6/2011 | Sadlier | E21B 44/00 703/7 |
| 2011/0220410 | A1 | 9/2011 | Aldred et al. | |
| 2013/0168084 | A1 | 7/2013 | Conn | |
| 2015/0369042 | A1* | 12/2015 | Samuel | E21B 43/10 702/9 |

OTHER PUBLICATIONS

International Preliminary Report on Patentability issued in International Patent application PCT/US2014/065141, dated Oct. 14, 2015, 18 pages.

* cited by examiner

AUTOMATIC WELLBORE CONDITION INDICATOR AND MANAGER

BACKGROUND

This disclosure relates generally to the field of construction of wellbores through subsurface formations. More particularly the disclosure relates to methods for automatically evaluating mechanical and hydraulic conditions within a wellbore during drilling operations so as to reduce chances of a drilling tool assembly and/or drill string become stuck in a wellbore or inducing damage to any part of the drill string.

Drilling wellbores through subsurface formations includes suspending a "string" of drill pipe ("drill string") from a drilling unit or similar lifting apparatus and operating a set of drilling tools and rotating a drill bit generally disposed at the bottom end of the drill string. The drill bit may be rotated by rotating the entire drill string from the surface and/or by operating a motor disposed in the set of drilling tool. The motor may be, for example, operated by the flow of drilling fluid ("mud") through an interior passage in the drill string. The mud leaves the drill string through the bit and returns to the surface through an annular space between the drilled wellbore wall and the exterior of the drill string. The returning mud cools and lubricates the drill bit, lifts drill cuttings to the surface and provides hydrostatic pressure to mechanically stabilize the wellbore and prevent fluid under pressure disposed in certain permeable formations exposed to the wellbore from entering the wellbore. The mud may also include materials to create an impermeable barrier ("filter cake") on exposed formations having a lower fluid pressure than the hydrostatic pressure of the mud in the annular space so that mud will not flow into such formations in any substantial amount.

It is known in the art to determine the condition of the wellbore with regard to removal of drill cuttings ("hole cleaning") by torque and drag plots. There are modeling programs known in the art that may be used to calculate an expected torque to be applied to the drill string and an amount of axial force consumed by friction between the wellbore wall and the drill string in view of drill string configuration and properties of the mud. The expected torque and drag may be compared to the measured torque and drag to determine if the cuttings are being completely removed, it being presumed that increases in either torque and/or drag values are indicative of incomplete hole cleaning. As a matter of ordinary practice this is done infrequently and is done more often in well planning and not during actual wellbore drilling operations. If torque and drag plots are used for operational analysis, they are typically performed manually.

The same type of analysis is known in the art to be performed for stand-pipe pressure (the pressure of the mud at the point at which it enters the drill string) and ECD (equivalent circulating density), that is, expected values modeled prior to or during drilling operations are compared to measured values. All of the analysis systems known in the art review individual symptoms of incomplete hole cleaning in isolation and do not provide the wellbore operator with an integrated analysis of all factors related to hole cleaning that may be indicative of increased risk of the drill string becoming stuck in the wellbore.

There are also programs known in the art that measure certain parameters and calculate a risk of differential sticking (i.e., the drill string becoming stuck by wiping through the filter cake in a formation with substantially lower fluid pressure than the hydrostatic pressure in the wellbore). Such programs are manually operated and may be difficult for the drilling unit operator to observe increased stuck pipe risk until it is too late.

SUMMARY

A method for monitoring condition of a wellbore includes initializing a value of at least one parameter having a relationship to likelihood of a drill string becoming stuck in a wellbore (the HCF). During drilling operations, at least one drilling parameter having a determinable relationship to the HCF is measured. In a computer, the value of the HCF is recalculated based on the at least one measured parameter. The initial value of the HCF and the recalculated values of the HCF are displayed to a user.

Other aspects and advantages will be apparent from the description and claims that follow.

DETAILED DESCRIPTION

Figure 1:
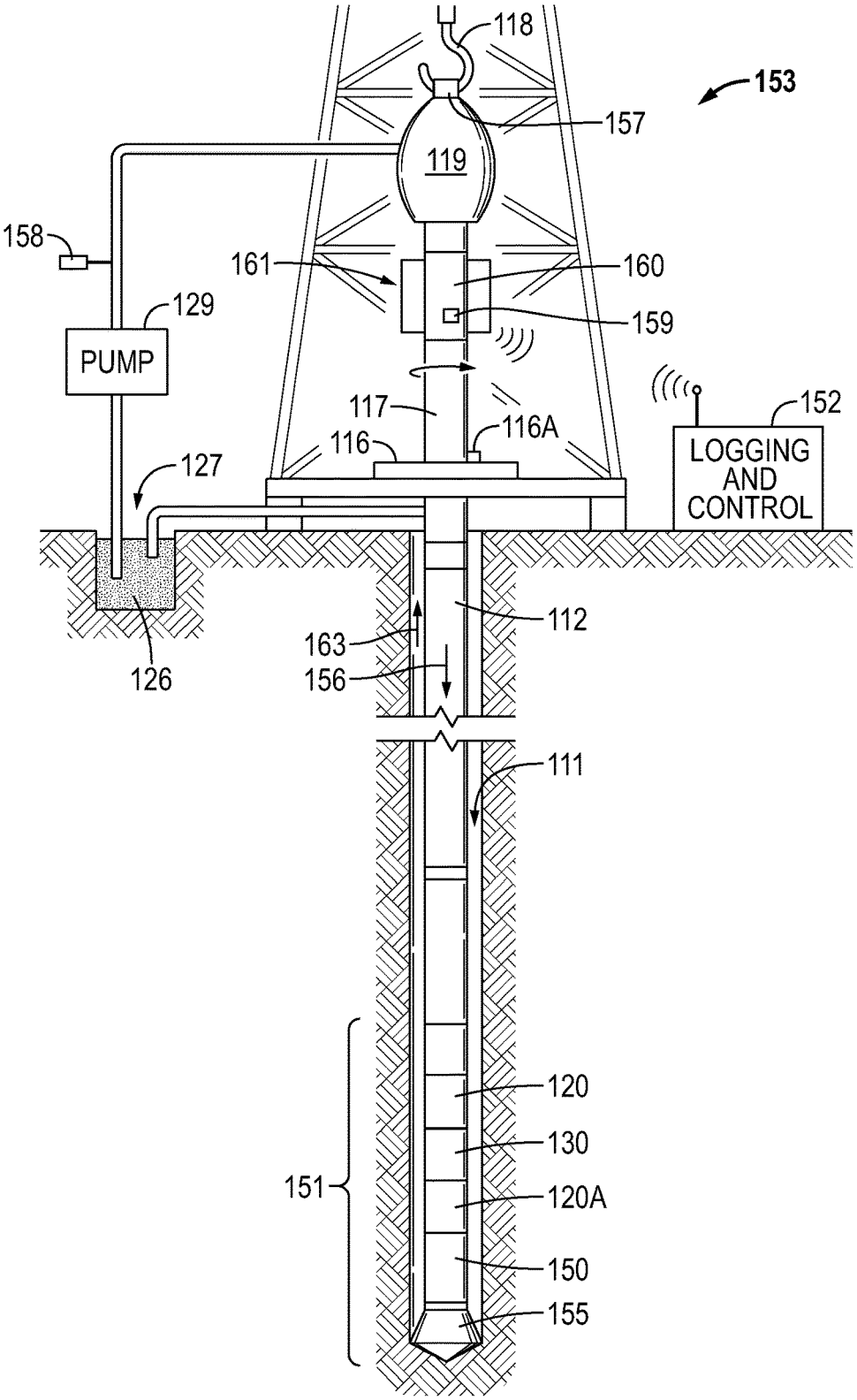
FIG. 1 shows an example drilling system.

FIG. 1 shows a simplified view of an example drilling and measurement system that may be used in some embodiments. The drilling and measurement system shown in FIG. 1 may be deployed for drilling either onshore or offshore wellbores. In a drilling and measurement system as shown in FIG. 1, a wellbore 111 may be formed in subsurface formations by rotary drilling in a manner that is well known to those skilled in the art. Although the wellbore 111 in FIG. 1 is shown as being drilled substantially straight and vertically, some embodiments may be directionally drilled, i.e. along a selected trajectory in the subsurface.

A drill string 112 is suspended within the wellbore 111 and has a bottom hole assembly (BHA) 151 which includes a drill bit 155 at its lower (distal) end. The surface portion of the drilling and measurement system includes a platform and derrick assembly 153 positioned over the wellbore 111. The platform and derrick assembly 153 may include a rotary table 116, kelly 117, hook 118 and rotary swivel 119 to suspend, axially move and rotate the drill string 112. In a drilling operation, the drill string 112 may be rotated by the rotary table 116 (energized by means not shown), which engages the kelly 117 at the upper end of the drill string 112. Rotational speed of the rotary table 116 and corresponding rotational speed of the drill string 112 may be measured un a rotational speed sensor 116A, which may be in signal communication with a computer in a surface logging, recording and control system 152 (explained further below).

The drill string 112 may be suspended fin the wellbore 111 from a hook 118, attached to a traveling block (also not shown), through the kelly 117 and a rotary swivel 119 which permits rotation of the drill string 112 relative to the hook 118 when the rotary table 116 is operates. As is well known, a top drive system (not shown) may be used in other embodiments instead of the rotary table 116, kelly 117 and swivel rotary 119.

Drilling fluid ("mud") 126 may be stored in a tank or pit 127 disposed at the well site. A pump 129 moves the drilling fluid 126 to from the tank or pit 127 under pressure to the interior of the drill string 112 via a port in the swivel 119, which causes the drilling fluid 126 to flow downwardly through the drill string 112, as indicated by the directional arrow 156. The drilling fluid 126 travels through the interior of the drill string 112 and exits the drill string 112 via ports in the drill bit 155, and then circulates upwardly through the annulus region between the outside of the drill string 112 and the wall of the borehole, as indicated by the directional arrows 163. In this known manner, the drilling fluid lubricates the drill bit 155 and carries formation cuttings created by the drill bit 155 up to the surface as the drilling fluid 126 is returned to the pit 127 for cleaning and recirculation. Pressure of the drilling fluid as it leaves the pump 129 may be measured by a pressure sensor 158 in pressure communication with the discharge side of the pump 129 (at any position along the connection between the pump 129 discharge and the upper end of the drill string 112). The pressure sensor 158 may be in signal communication with a computer forming part of the surface logging, recording and control system 152, to be explained further below.

The drill string 112 typically includes a BHA 151 proximate its distal end. In the present example embodiment, the BHA 151 is shown as having a measurement while drilling (MWD) module 130 and one or more logging while drilling (LWD) modules 120 (with reference number 120A depicting a second LWD module 120). As used herein, the term "module" as applied to MWD and LWD devices is understood to mean either a single instrument or a suite of multiple instrument contained in a single modular device. In some embodiments, the BHA 151 may include a rotary steerable directional drilling system (RSS) and hydraulically operated drilling motor of types well known in the art, collectively shown at 150 and the drill bit 155 at the distal end.

The LWD modules 120 may be housed in one or more drill collars and may include one or more types of well logging instruments. The LWD modules 120 may include capabilities for measuring, processing, and storing information, as well as for communicating with the surface equipment. By way of example, the LWD module 120 may include, without limitation one of a nuclear magnetic resonance (NMR) well logging tool, a nuclear well logging tool, a resistivity well logging tool, an acoustic well logging tool, or a dielectric well logging tool, and so forth, and may include capabilities for measuring, processing, and storing information, and for communicating with surface equipment, e.g., the surface logging, recording and control unit 152.

The MWD module 130 may also be housed in a drill collar, and may contain one or more devices for measuring characteristics of the drill string 112 and drill bit 155. In the present embodiment, the MWD module 130 may include one or more of the following types of measuring devices: a weight-on-bit (axial load) sensor, a torque sensor, a vibration sensor, a shock sensor, a stick/slip sensor, a direction measuring device, and an inclination and geomagnetic or geodetic direction sensor set (the latter sometimes being referred to collectively as a "D&I package"). The MWD module 130 may further include an apparatus (not shown) for generating electrical power for the downhole system. For example, electrical power generated by the MWD module 130 may be used to supply power to the MWD module 130 and the LWD module(s) 120. In some embodiments, the foregoing apparatus (not shown) may include a turbine-operated generator or alternator powered by the flow of the drilling fluid 126. It is understood, however, that other electrical power and/or battery systems may be used to supply power to the MWD and/or LWD modules.

In the present example embodiment, the drilling and measurement system may include a torque sensor 159 proximate the surface. The torque sensor 159 may be implemented, for example in a sub 160 disposed proximate the top of the drill string 112, and may communicate wirelessly to a computer (see FIG. 11) in the surface logging, recording and control system 152, explained further below. In other embodiments, the torque sensor 159 may be implemented as a current sensor coupled to an electric motor (not shown) used to drive the rotary table 116. In the present example embodiment, an axial load (weight) on the hook 118 may be measured by a hookload sensor 157, which may be implemented, for example, as a strain gauge. The sub 160 may also include a hook elevation sensor 161 for determining the elevation of the hook 118 at any moment in time. The hook elevation sensor 161 may be implemented, for example as an acoustic or laser distance measuring sensor. Measurements of hook elevation with respect to time may be used to determine a rate of axial movement of the drill string 112. The hook elevation sensor may also be implemented as a rotary encoder coupled to a winch drum used to extend and retract a drill line used to raise and lower the hook (not shown in the Figure for clarity). Uses of such rate of movement, rotational speed of the rotary table 116 (or, correspondingly the drill string 112), torque and axial loading (weight) made at the surface and/or in the MWD module 130 may be used in one more computers as will be explained further below.

The operation of the MWD and LWD instruments of FIG. 1 may be controlled by, and sensor measurements from the various sensors in the MWD and LWD modules and the other sensors disposed on the drilling and measurement unit described above may be recorded and analyzed using the surface logging, recording and control system 152. The surface logging, recording and control system 152 may include one or more processor-based computing systems or computers. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for processing data received at the surface from the BHA 155 (e.g., as part of an inversion to obtain one or more desired formation parameters), and from the other sensors described above associated with the drilling and measurement system. The surface logging, recording and control system 152 may include one or more computer systems as will be explained with reference to FIG. 11. The other previously described sensors including the torque sensor 159, the pressure sensor 158, the hookload sensor 157 and the hook elevation sensor 161 may all be in signal communication, e.g., wirelessly or by electrical cable with the surface logging, recording and control system 152. Measurements from the foregoing sensors and some of the sensors in the MWD and LWD modules may be used in various embodiments to be further explained below.

Having explained a drilling and measurement system capable of drilling a wellbore through subsurface formations and making measurements of various parameters related to operating the drilling components of the drilling and measurement system, an example method will now be explained for monitoring condition of the wellbore as it may relate to conditions likely to result in increased risk of a drill string becoming stuck in the wellbore. A method according to the present disclosure, which may be referred to as a hole condition monitor" ("HCM"), uses a dynamically updated wellbore condition model to provide substantially instantaneous display of wellbore ("hole") condition information and provides automatic guidance to the system user. Such guidance may take the form of a computer generated display observable by the system user for corrective action to be undertaken by the wellbore operator and/or the drilling and measurement system operator to reduce the risk of the drill string (112 in FIG. 1) becoming stuck in the wellbore (111 in FIG. 1) and to provide a high quality wellbore that ensures tripping and/or running of casing, liner or similar wellbore completion pipe into the wellbore successfully. Such a method may:

a) Provide real-time analysis of the extent of wellbore drill cuttings cleaning.
b) Provide warning of potential differential-pressure caused drill string sticking conditions.
c) Provide warning and possible corrective action if the trajectory or the tortuosity deviates from a specific key performance indicator or other predetermined limit.
d) Predict and identify different types of wellbore condition-related drilling problems in real-time, such as washouts, vibration, wellbore cuttings cleaning, differential-pressure induced sticking, well trajectory tortuosity, etc.
e) Provide clear indication, notification, reason and recommended actions for wellbore condition problems set forth above.
f) Analyze variance of the foregoing conditions on a formation-basis level using both offset well and current well information.
g) Analyze variance of a wellbore ("hole") condition factor (HCF) curves and/or (hole condition monitor) HCM logic with respect to wellbore depth to generate indicators and alarms related to likelihood of stuck drill string, casing or liner and/or quality of the drilled wellbore.

A component of the HCM is the Hole Condition Factor (HCF). The HCF is a parameter that may be derived from other parameters (explained further below) related to wellbore ("hole") condition evaluation such as drag (axial friction between the wellbore wall and the drill string), torque applied to the drill string to effect rotation thereof, equivalent circulating density (ECD, i.e., equivalent density of the drilling fluid when moving through the drill string and wellbore) and equivalent static density (ESD) of the drilling fluid, drilling fluid standpipe pressure (SPP, i.e., pressure at the discharge side of the pump 129 in FIG. 1), a hole cleaning index (HCI) to be explained below, Filter Cake Quality to be explained below, and a Vibration Parameter to be explained below. Each of the foregoing parameters, as well as other parameters such as tortuosity are drilling parameters having a known correspondence to likelihood of the drill string (112 in FIG. 1) becoming stuck in the hole or wellbore (111 in FIG. 1). For purposes of the present description, the term "drilling operations" may include any operation that takes place with a drill string in a wellbore, non-limiting examples of which may include drilling, tripping (moving the entire drill string into or out of the wellbore), washing, reaming and circulating drilling fluid through the drill string and wellbore annular space with the drill string axially stationary in the wellbore (111 in FIG. 1).

HCF may be defined as a function of the foregoing parameters:

$$\text{Hole Condition Factor} = f(\text{Drag \& Torque, ECD \& ESD, SPP, HCI, Filter Cake Quality, Vibration Parameter})$$

Hole Condition Manager (HCM) records in a computer or computer system (see FIG. 11) a history of estimations and/or measurements of at least some or all of the foregoing parameters in order to enable prediction of the foregoing parameters at ahead of time (e.g., to a selected drill string depth position in the wellbore at a selected distance beyond the current position of the drill string along a selected trajectory). HCM may calculate trends for a selected number of segments of or stands (assembled segments of drill string components, usually but not exclusively three per stand) ahead of the present drill string position in the wellbore using the history (accumulated recorded measurements) developed from measurements made during various drilling procedures and real-time measurements and/or estimations for each of the foregoing parameters. Trends in the measurements may be calculated from the measurement history and current measurements in some examples using a method such as one described in U.S. Patent Application Publication No. 2011/0220410 filed by Aldred et al. Safe boundaries for each of (or any subset of) the foregoing parameters may be estimated based on extrapolation of the foregoing trends. Safe boundaries may be defined as upper and lower limits for each parameter which substantially avoid increased risk of the drill string becoming stuck in the wellbore. If a measured value of any one or more of the foregoing parameters is beyond the defined safe boundaries, HCM may generate a signal, e.g., a warning or alarm display observable by the system user and/or generate an instruction to be displayed for observations by the user as to a suitable remedial response.

HCM may analyze a combination of parameters such as: Filter Cake Quality, initial peak torque on startup of rotation of the drill string (112 in FIG. 1) and overpull (excess axial loading on the hook on initial lifting of the drill string in excess of its actual weight plus a calculated static friction) values and trends of the foregoing to determine the likelihood of the drill string becoming stuck in the wellbore. The foregoing overpull and initial peak torque are known to be related to the drag and torque parameters used to calculate the HCF using the HCF calculation function described above.

Combination of information from various HCF parameters may be used in the computer or computer system (FIG. 11) to generate specific warning indicators to be displayed to the system user or to generate commands to an automatic drilling operating control unit, e.g., implemented in the surface logging, recording and control unit (152 in FIG. 1), that automatically operates the drilling and recording system. For example, increased drag, increased SPP and increased HCI may indicate inadequate wellbore drill cuttings cleaning and HCM may generate a relative numerical value to display to the user how deficient the wellbore cuttings cleaning is from complete.

As previously explained, a principal parameter in determining wellbore condition is the HCF. An equation to calculate the HCF may take any form, for example a linear combination, with a coefficient for each of a same number of parameters. The physical property represented by each of the parameters, e.g., A through F in the following example equation will be further explained below. A sample form of such an equation is presented below:

$$\text{Hole Condition Factor}=c_A \cdot A+c_B \cdot B+c_C \cdot C+c_D \cdot D+c_E \cdot E+c_F \cdot F$$

Figure 2:
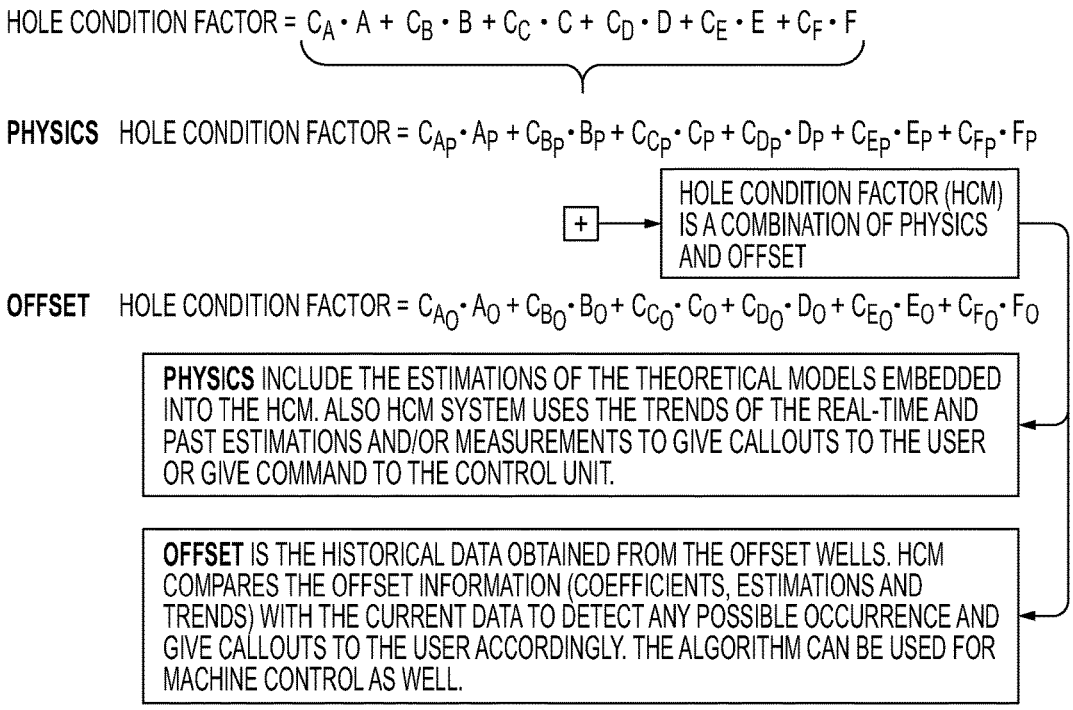
FIG. 2 shows an example hole condition factor and parameters used to calculate such factor.

The coefficients in the above equation may be initialized and recalculated in the computer or computer system (FIG. 11) during drilling operations. HCF calculation may use both offset (nearby) and current wellbore measurements for initialization and for recalculation thereof. In FIG. 2, an example structure of the HCF is presented. An offset wellbore's coefficients may be used as a reference for the current wellbore. The sum of the coefficient may be set to unity. Also, if a drilling problem had occurred in the offset wellbore, and when comparing trends in the offset wellbore to the current wellbore, if a similar pattern is observed, the computer system (FIG. 11) may drive a display observable by the system user an indicator or warning specially addressing the event that occurred in the offset wellbore. In the present example, the HCF may represent a combination of factors based on physical principles (e.g., theoretically calculated parameters based on information concerning properties of the drill string components and the drilling fluid properties) and on data obtained from nearby ("offset") wellbores or wellbores having been drilled through similar formations using, for example, similar drill string components and drilling fluid composition.

Even if one of the input parameters is missing, the sum of the coefficients may still be set to unity. By setting the sum of the coefficients to unity the HCF calculation may still be useful within the truncated number of input parameters. For example and without limitation:

$$c_A+c_B+c_C+c_D+c_E+c_F=1$$

$$c_{A_P}+c_{B_P}+c_{C_P}+c_{D_P}+c_{E_P}+c_{F_P}=1$$

$$c_{A_0}+c_{B_0}+c_{C_0}+c_{D_0}+c_{E_0}+c_{F_0}=1$$

Figure 3:
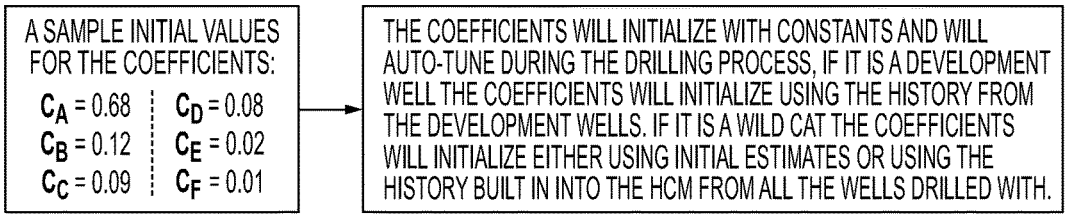
FIG. 3 explains initialization of the coefficients and a sample set of coefficients is presented.

FIG. 3 explains initialization of the coefficients for each of the parameters A-F and a sample set of coefficients is presented. Initialization may be based, for example, on the drill string component configuration, wellbore diameter (generally the drill bit diameter, wellbore expected pressure profile and drilling fluid properties.

Each parameter A-F in an example embodiment of the HCF calculation is explained below in more detail.

Drag and Torque Calculation

The Drag and Torque calculation may use a dynamic torque and drag model which is calculated in real-time. Drag and torque models of various kinds are known in the art. The drag and torque model takes into account the wellbore inclination and wellbore curvature, the drill string configuration and the properties of the drilling fluid ("mud"). The HCM program may cause the computer (FIG. 11 and/or in 152 in FIG. 1) to compare measured (e.g., using the hookload and torque sensors described with reference to FIG. 1) and estimated (from a modeling computer program) friction factors. Measured friction factor may be estimated by measuring the amount of axial force required to move the drill string axially within the wellbore with respect to the weight of the drill string, i.e., the amount of force required to move the drill string in the absence of friction. The amount of force may be estimated from the measured weight of the drill string at the surface (e.g., "hookload" as measured by sensor 157 in FIG. 1) when moving out of the wellbore, or the slackoff, i.e., the reduction in measured weight as the drill string is moved into the wellbore. Measurements of, and calculations of estimated torque applied to the drill string to cause rotation thereof may also be used in some embodiments to calculate friction factor.

Parameter "A" may be defined as the ratio of the measured friction factor to the model-calculated friction factor:

$$A = 100 \cdot \left| \frac{ff_{measured} - ff_{calculated}}{ff_{measured}} \right|$$

ECD and ESD Calculation

The HCM program may calculate in the computer system (in the absence of a bottom hole pressure [PWD] sensor, e.g., in the MWD module) or measures the ECD & ESD. The calculation may take into account the wellbore inclination and the wellbore curvature. The calculation may use a wellbore collapse pressure or formation pore fluid pressure as a lower boundary and a minimum exposed formation fracture pressure as an upper boundary for both parameters. Parameter "B" may be defined by the equation below wherein FP represents the fracture pressure (the upper safe boundary) and CP represents the collapse pressure (the lower safe boundary). CP may be substituted by PP (formation pore fluid pressure) as explained above in the calculation of B.

$$B = 100 \cdot \left| \frac{ECD(\text{or } ESD) - CP}{FP - CP(\text{or } PP)} \right|$$

SPP

An expected SPP may be calculated by HCM program in the computer system (FIG. 11 and/or 152 in FIG. 1) taking into account the wellbore inclination and wellbore curvature as well as the drill string configuration and mud properties (e.g., viscosity) wherein the computer calculates what an expected standpipe pressure should be. The measured SPP may be compared to the expected SPP in the computer system and a warning signal and/or corrective action may be displayed to the system user when a difference between the measured SPP and the expected SPP exceeds a predetermined threshold. Parameter C may be defined by the following expression:

$$C = 100 \cdot \left| \frac{SPP_{measured} - SPP_{calculated}}{SPP_{measured}} \right|$$

Hole Cleaning Index (HCI)

The HCM program may calculate the HCI, which is an indicator of effectiveness of drill cuttings transport to the surface by analyzing the drilling parameters and calculating a continuous index for the hole cleaning. The drilling parameters may be, for example and without limitation, rate of penetration, inclination of the wellbore, drilling fluid flow rate. An assessment of the hole cleaning (i.e., cuttings transport) may be made using analytical models and any historical data. HCI may connect the information using a computer implemented learning algorithm. The information can be from the offset and/or other previously drilled wellbores. The parameters that proved successful hole cleaning considering the drilling mud properties may be correlated to the parameters in the currently drilling wellbore. The HCI may also include experimental data that obtained from m hole cleaning for vertical, inclined and horizontal wellbores. The following expression may be used to define parameter D:

$$D=100\cdot HCI$$

Filter Cake Quality

Filter cake quality as used by the HCM program may be either a subjective assessment of the filter cake's quality or a model/procedure developed to score the filter cake quality. Filter cake quality may be based on the mud engineer's (person responsible for maintaining correct drilling mud composition and density) subjective assessment of the filter cake formed on permeable formations exposed to the wellbore. The subjective assessment may be facilitated by use of mud test equipment and procedures as described below. Filter cake quality may be, for example, normalized to be in a range of 0 to 100. Zero may represent the lowest quality and the value of 100 may be used for the best quality. As known in the art, mud may contain materials such as bentonite clay, which forms an impermeable filter cake on the wellbore wall in permeable formations where the fluid pressure therein is lower than the hydrostatic or hydrodynamic pressure in the wellbore. The quality assessment may be performed, e.g., by the mud engineer using surface test instrumentation, for example, according to procedures set forth by the American Petroleum Institute, Washington, D.C. (API), for example API-RP (recommended practice) No. 29. Tests performed according to the foregoing recommended procedure may include parameters such as: filtrate (liquid phase) loss volume, cake thickness, and physical properties of the filter cake. The foregoing may be used to define parameter E according to the following expression $$E=100-F$$

Vibration Parameter

The HCM program may calculate the vibration parameter F in the computer or computer system from measurements of torque ($\tau$) applied to the drill string (112 in FIG. 1) at the surface (e.g., using torque sensor 159), and/or if available, proximate the drill bit (155 in FIG. 1) using a measurement while drilling (MWD) module sensor. The amount of axial force (weight) applied to the drill bit (155 in FIG. 1) "WOB" may also be estimated using measurements of the weight of the drill string suspended by the drilling unit, e.g., using the hookload sensor (157 in FIG. 1) and/or from an MWD sensor in the MWD module proximate the drill bit if available. The vibration parameter may take into account the wellbore trajectory. The vibration parameter may be defined as parameter F as follows:

$$F=\text{Vibration Parameter}$$

A range for F may be 0-100.

Other parameters related to the condition of a wellbore may be included in the equation in combination with the parameters described previously. As an example, wellbore path tortuosity can be included. Tortuosity may be defined as deviation from a straight well path. In the case where only directional survey information is available, HCF can be used to analyze and quantify the tortuosity using the directional survey information. HCF may calculate a number corresponding to the severity of the deviation along the well path and thereby quantify the tortuosity. The overall tortuosity can be quantified by the deviation amount, direction and length.

HCF may construct an apparent well path using the directional survey information (using well path calculation procedures known in the art) and curve fitting substantially in real-time. For example, as directional survey measurements are made, a curve may be fit on the survey points and deviation of a point from the fit curve can be calculated. Deviation from the well path is an indication of tortuosity and it can be quantified by analyzing the survey points, such as the spatial position of the survey points, tangent variation along the curve or the curvature variance per unit length, etc. Different survey data fitting techniques may be used. For example, the fitting may be, without limitation, linear, polynomial, etc., and multiple curves may be fit as well. The curve fit may be applied for a section of the wellbore or to to the entire wellbore and the curve fit may be static or moving. Overall tortuosity of the wellbore may be quantified using, for example, deviation average between the fit and the directional survey points, area under the directional survey data points, etc. Tortuosity may be calculated considering the survey data density interval. High density interval surveys, such as a directional survey measured about every 9 feet (3 meters), or directional surveys taken every time a joint or segment of pipe is added to the drill string (FIG. 1) will more accurately determine the actual wellbore tortuosity compared to surveys taken at longer measured depth intervals, e.g., every 90 feet (30 meters). Therefore, tortuosity can be quantified using the effect of directional survey data density by adjusting the warning threshold values to display an appropriate message to the user. A well path schematic can be generated and conducted to a user interface or similar computer display including the HCF's tortuosity calculations and the position of the drill bit for observation by the user. This allows the user to have current tortuosity information while tripping (casing, drill string, etc.) through zones where high tortuosity is calculated. The pattern of the deviation is also considered. Patterns such as spiraling or well path ripples can reveal more information. For example, ripples can be caused by slide and rotary drilling sequences with a steerable drilling motor, or a low pitch length helix can be caused by excessive WOB, etc. Such information may be used to generate a warning indicator on a display or user interface to alert the user to the existence of a specific problem. Additionally, a warning indication can be displayed to the user in the instance where a specific wellbore section can potentially be hazardous for any tubular type in the drill string or casing. For example, during drilling a dogleg severity (DLS) displayed on the well path display can be created wherein an excessive wear or tubualar failure during the casing run can potentially be encountered. The user may observed the warning indicator in real-time, wherein the warning indicator is generated corresponding to the tubular type and the calculated tortuosity.

If the length between two directional survey points is within a predetermined range that possibly can cause an increase to the drag or torque, then a length-dependent value may be calculated for that wellbore section. If a torque and drag analysis is available, the side forces of the tubular that are in contact with the wellbore wall may be calculated and may be combined with the length analysis to better quantify the existence of possible problems that occur due to tortuosity. An eccentricity function may be used in conjunction with the foregoing method to estimate the locations of contacts between the wellbore wall along the well path and the drill string.

Regulatory agency required directional surveys are typically measured at every joint or at one-half or at one full length of stand (i.e., a selected number, typically three, interconnected joints of drill pipe and/or drilling tools). Such survey interval may be insufficient to identify the micro tortuosity and/or spiraling of the wellbore, both of which may substantially contribute to the overall tortuosity of a wellbore. Continuous inclination and continuous azimuth measurements that may be using a drilling tool deployed directional surveying device (e.g., as explained with reference to FIG. 1) may be used with the methods described previously to quantify the overall condition of the wellbore. Similarly, HCF may be used with high data density directional surveys and/or any wireline instrument measurements measuring any parameter(s) indicative of the geometry of the wellbore, for example caliper tool measurements.

HCF can make computations with various grades of data availability. If only surface measurements are available, HCF may be calculated using a simple logic and trend analysis. As an example, HCF calculations may be used to analyze worsening trends where HCF is based only on surface measurements such as hookload, standpipe pressure, surface torque, etc. HCF uses the rig states and filter pick up (lifting the drill string), slack off and rotating off bottom hookload measurements from the total hookload measurement. A moving linear trend detection may used to determine whether there is a trend change indicative of a worsening wellbore condition. For example, if there is a trend change in the pick up measurements during tripping out and if the trend change indicates an increase in hookload (which is indicative of worsening conditions), then HCF may generate and display an alert to the user.

The relationship between the hookload and the wellbore measured depth may not be linear, especially if the wellbore is not vertical and straight. The torque and drag will be vary where directional drilling is initiated, i.e., at a "kick-off" from a vertical wellbore trajectory. The computer system may calculate rotating off bottom values during drilling and these may be analyzed using the HCF for a trend change. While tripping out, if there is a trend change indicative of a worsening condition and if the trend change depth is proximate to the trend change of the rotating off bottom curve, then this will indicate a well path curvature change, hence no alarm will be generated. Otherwise the user display may have a warning indication shown thereon. The foregoing procedure may extend to slack off during tripping in.

Discrete values of the above measurements may be segmented into trends along a selected length of the wellbore, for example, using the algorithm described in the Aldred et al. publication cited above. The values of the foregoing parameters may then be forecast by the computer or computer system for a selected time interval or depth distance ahead of the current time or depth position in the wellbore using trends identified using the same algorithm.

Figure 4:
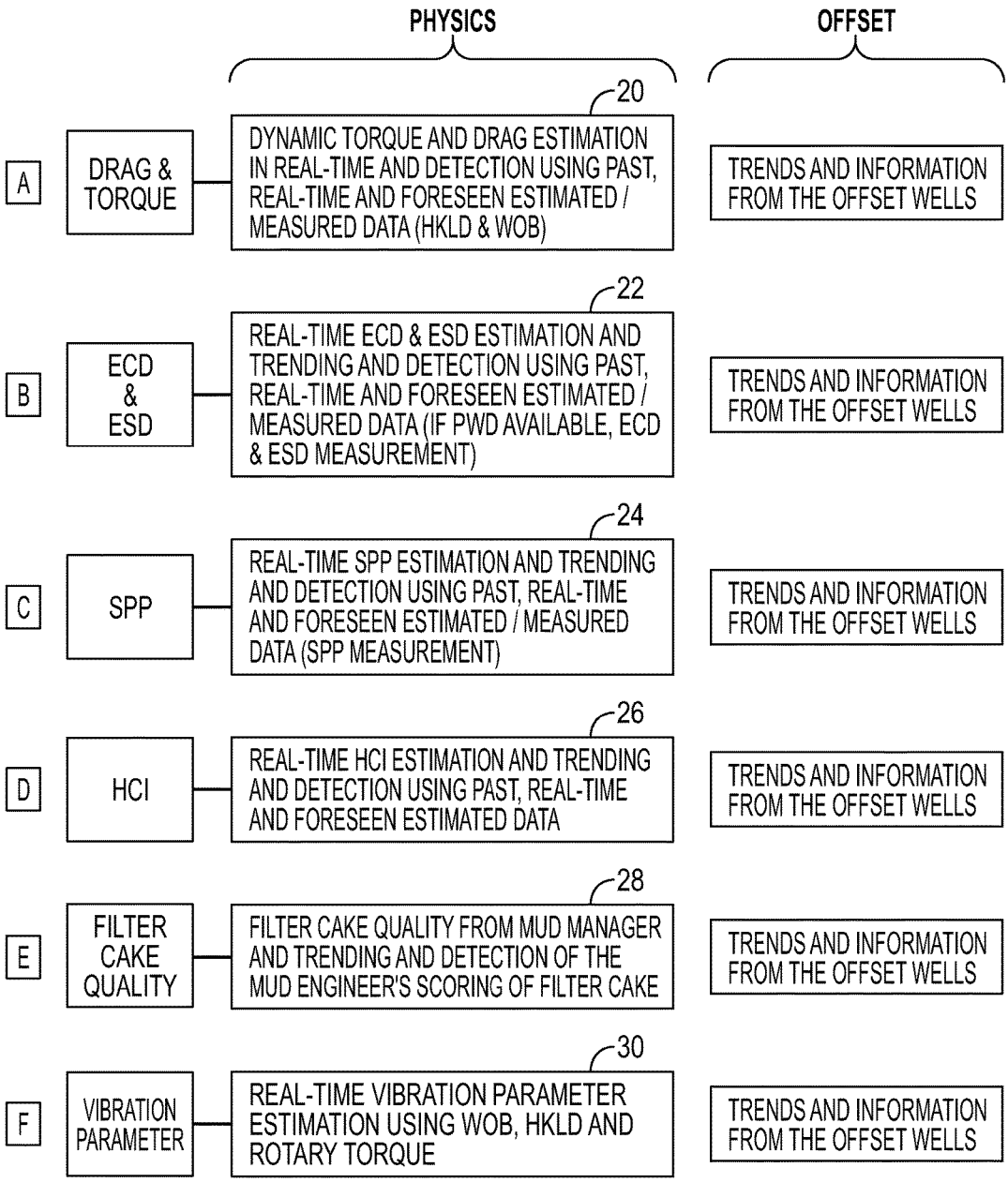
FIG. 4 shows how to calculate various parameters used in a hole condition monitor system according to the present disclosure.

A detailed explanation of the structure of HCM program is shown in FIG. 4. At 20, dynamic torque and drag estimation may be calculated in real-time and trending may be determined in the computer or computer system using past, real-time and forecast estimated/measured data, e.g., hookload and WOB. The foregoing is parameter A as explained above. At 22, real-time ECD & ESD estimation and trending and detection may be performed using past, real-time and forecast estimated/measured data (if PWD available, ECD & ESD inferred measurements may be used). The foregoing is parameter B as explained above. At 24 real-time SPP estimation and trending and detection using past, real-time and forecast estimated/measured data (SPP measurement). The foregoing is parameter C as explained above. At 26, real-time HCI estimation and trending and detection may be calculated using past, real-time and forecast data. The foregoing is parameter D as explained above. At 28, filter cake quality from the mud engineer and trending and detection of the mud engineer's scoring of filter cake may be performed as explained above. The foregoing is parameter E as explained above. At 30, the vibration parameter estimation may be performed in real time using WOB, hookload (or downhole weight as explained above) and torque. The foregoing is parameter F as explained above. Any of parameters A through F may also be estimated using offset well data as shown in FIG. 4. The foregoing parameters may all be used by the computer or computer system to calculate HCF in the past, at the current drill bit position and forecast to a selected depth different from the current position or time interval in the future as explained above. For any or all of the foregoing parameters, as shown in FIG. 4, corresponding parameters from one or more offset wells may be used in the computer or computer system to initialize values, update values and import trends in the values thereof.

Figure 5:
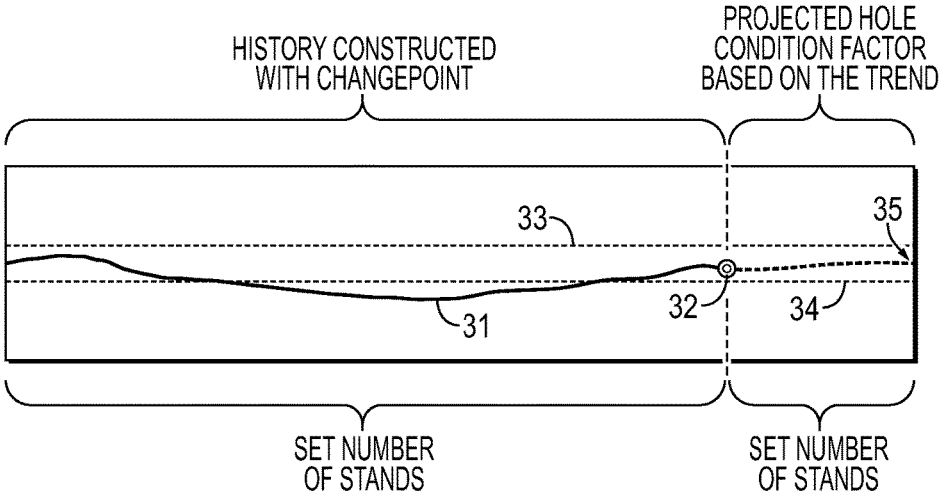
FIG. 5 shows an example hole condition factor plot.

An example user display plot of the HCF is shown in FIG. 5, wherein values of the foregoing parameters calculated in the computer or computer system may be used to drive a display observable by the system user. The system user may observe both how the HCF has changed over time at curve segment 31, the current value of HCF at 32, as well as observe a prediction of how the value of HCF may be expected to change based on current conditions and trends at 35. Upper and lower boundaries for safe values of HCF, calculated as previously explained, are shown at 33 and 34, respectively in FIG. 5.

Regardless of its respective coefficient, if any one or more of the parameters used to calculate HCF meets the following conditions, the HCF will increase. If the HCF increases beyond a preselected boundary limit, e.g., limit 33 in FIG. 4, the computer system may generate alerts and/or recommended corrective action to be displayed to the user, e.g., the drilling unit operator. The conditions may be, for example:

a) If any of the parameters A through F increases over a selected or predetermined threshold
b) If any of the parameters A through F is forecast (e.g., using the algorithm disclosed in the Aldred et al publication) to exceed a selected threshold within a predetermined number of subsequent drill string segments or stands (based on the trends)
c) By checking static initial torque and overpull trends and combining the mud filtrate loss information, the system generates an alert for possible differential sticking.

Using the forecast values of HCF as shown in FIG. 5 at 35, the user may take corrective action to cause the forecast values to fall within the safe range if the forecast values are expected to fall outside the safe range, e.g., exceed the upper limit 33 in FIG. 5. In other embodiments, an automatic drilling and measurement system control unit, e.g., system 152 in FIG. 1, may automatically implement the foregoing corrective action. "Stands" as used herein may mean a selected number of segments of drill pipe and/or drilling tools such as BHA components threadedly connected end to end. A stand may comprise three segments of drill pipe and or drilling tools, however the number of segments ("joints") in the stands is not a limit on the scope of the present disclosure.

Figure 6:
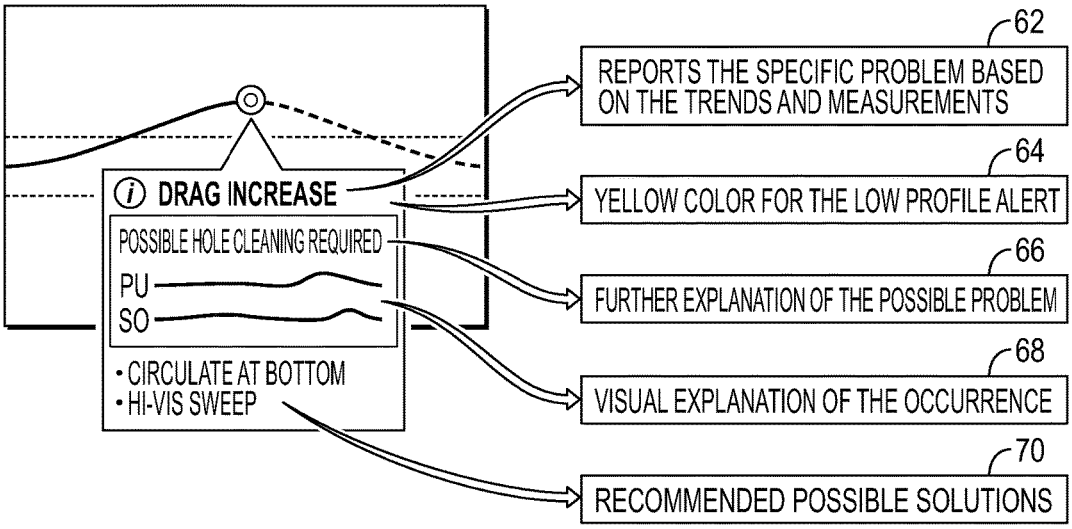
FIGS. 6 through 9 show various alarm indicators and corrective action displays generated by an example method according to the disclosure.
Figure 7:
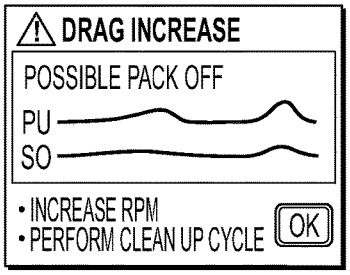
Figure 8:
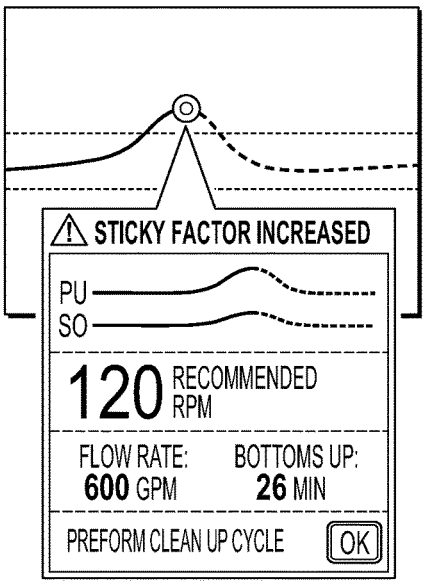
Figure 9:
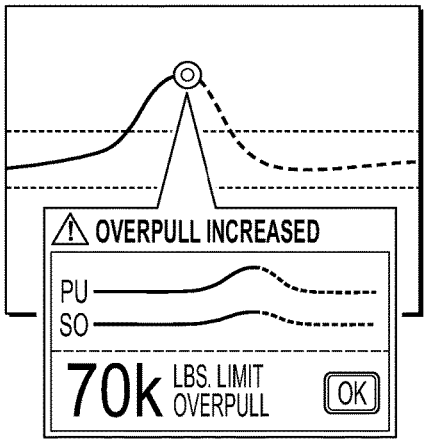
Figure 11:
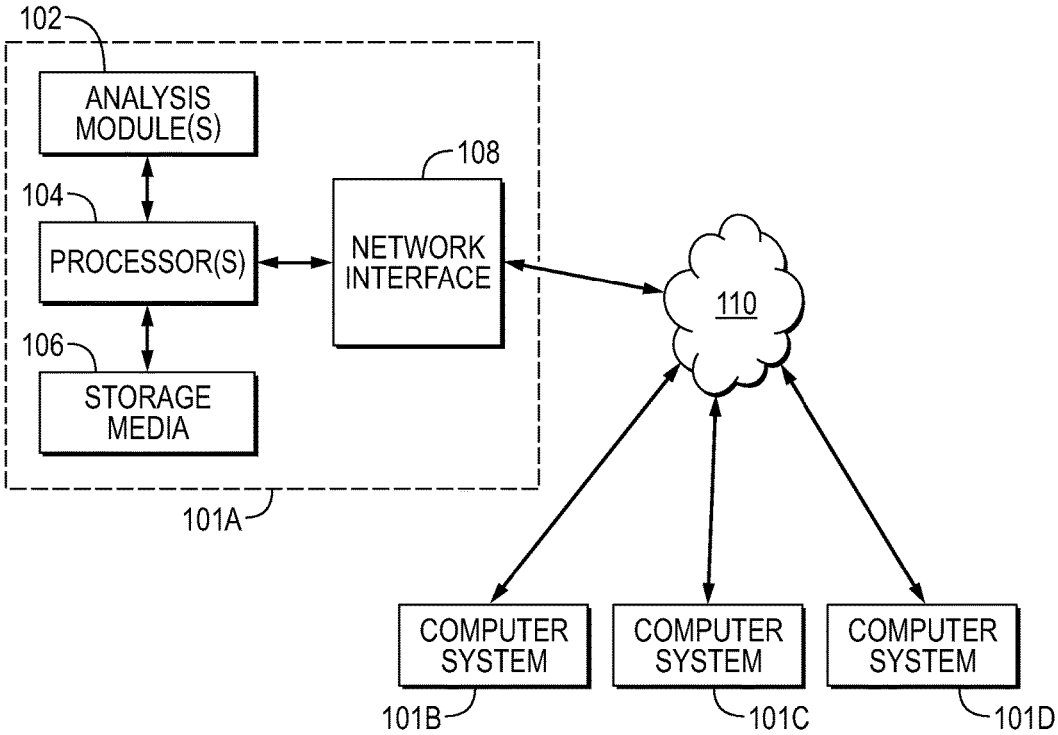
FIG. 11 shows an example computer system that may be used in some implementations.

FIGS. 6, 7, 8 and 9 show sample alarms and corrective action displays (that may be displayed by any suitable visual display device in signal communication with the computer or computer system in FIG. 11). In FIG. 6, at 62, a specific drilling problem or hazardous condition may be identified by the calculation performed in the computer system. At 64, a color coding or other visual coding may indicate a degree of severity of the drilling problem or hazardous condition. At 66, possible causes of the problem may be determined in the computer system by, e.g., correlation of changes in the HCF to previously identified causes, and the possible causes displayed as shown. At 68, a visual display of changes in selected parameters over a predetermined length of the wellbore may be presented to the user. At 70, the computer system may calculate possible corrective actions to alleviate the hazardous condition or reduce the possibility of the indicated drilling problem. The corrective action may be displayed to the system user. FIG. 7 shows a more detailed alert message displayed to the user with generalized actions to be undertaken by the drilling system operator to correct the hazard identified in the alert message. FIG. 8 shows a more detailed set of corrective actions, including, for example, an suitable drill string rotation speed and an amount of non-drilling, drilling fluid circulation time to clean the wellbore sufficiently to alleviate the hazardous condition. FIG. 9 shows another example of a warning with specific recommendations as to an amount of overpull consistent with reducing risk of the drill string becoming stuck in the wellbore.

Figure 10:
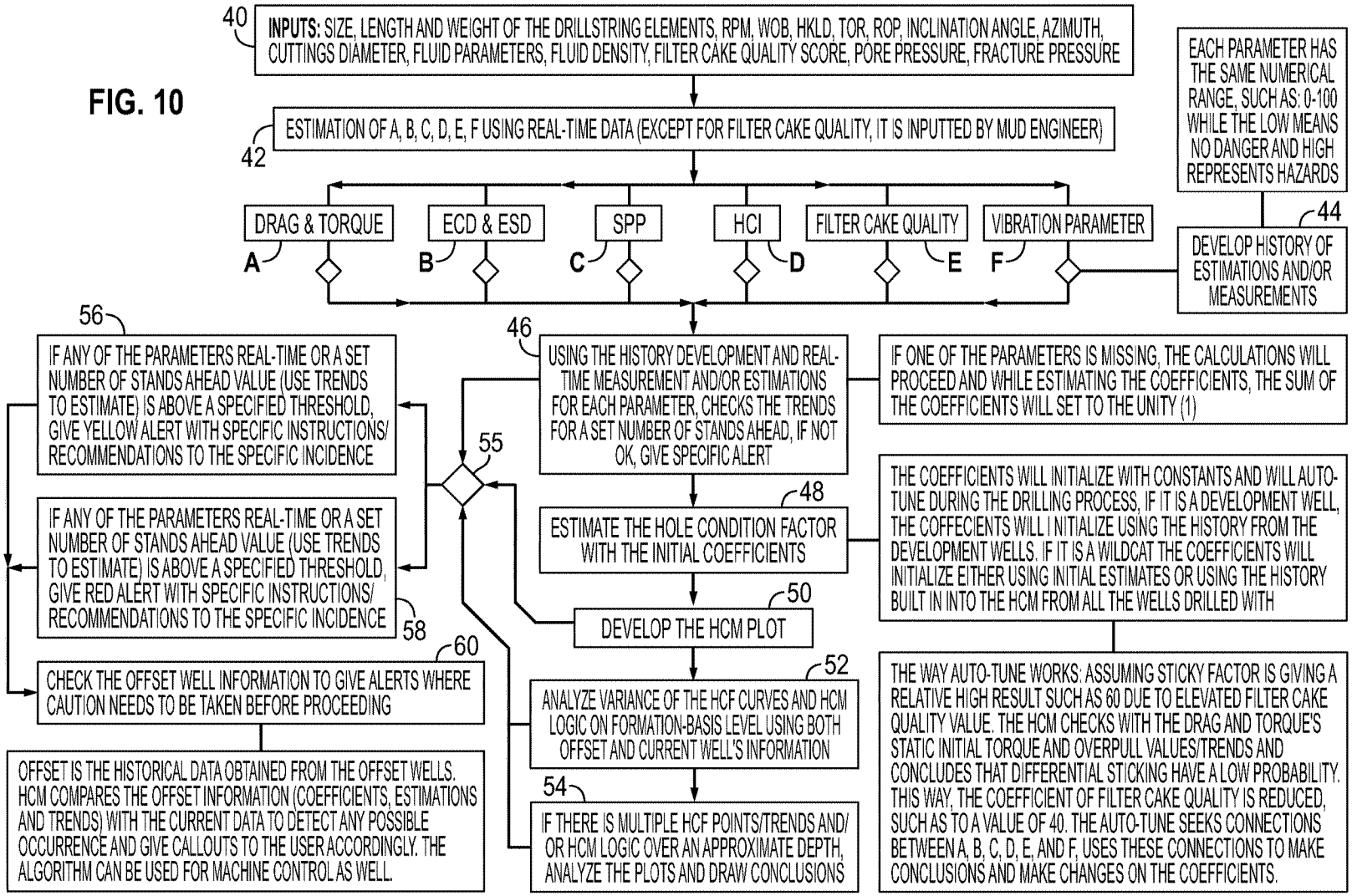
FIG. 10 shows a flow chart of an example technique for calculating the hole condition monitor.

FIG. 10 shows a flow chart of an example technique usable by the HCM program for calculating and displaying the HCF. At 40, data are entered into the computer system (described below with reference to FIG. 11). The data may include size, length and weight of the drill string elements, rotary drill string speed (RPM), WOB, hookload, torque, rate of axial elongation of the wellbore (rate of penetration—ROP), wellbore inclination angle, wellbore azimuth, cuttings size and/or size distribution, drilling mud parameters, filter cake quality score, formation pore fluid pressure or wellbore collapse pressure, and formation fracture pressure. At 42, parameters A, B, C, D, E and F may be initially estimated as explained above with reference to FIG. 4. During drilling operations, one or more of the foregoing parameters may be recalculated using measurements as explained with reference to each parameter and FIG. 4. At 44, trends in the parameters may be identified over a number of parameter values using, for example, the algorithm described in the Aldred et al. publication cited herein above. At 46, using the identified trends, real-time calculations and forecast values for each parameter based on the identified trends, the forecast values for each parameter for a selected number of drill string segments or stands ahead of the current drill string position (either moving into or out of the wellbore) may be compared to a selected upper and lower threshold boundary for each parameter. If the forecast value for any one or more parameters A, B, C, D, E, F falls outside the selected thresholds, an alert may be presented and/or a corrective action may be presented to the user, e.g., as shown in and explained with reference to FIGS. 6-9.

At 48, the HCF may be calculated in the computer system using an initial set of coefficients. The coefficients may initialize as estimates in newly drilled areas and may auto-tune during the drilling process. In areas with sufficient offset wellbore data, the coefficients may be initialized using data from offset wells. The coefficients may also be initialized either using initial estimates or using the history built in into the HCM from all the wells drilled using the system. The auto-tuning of the coefficients may be performed by, for example assuming the HCM is a relatively high value such as 60 due to elevated filter cake quality value. The HCM scans the drag and torque coefficient's static initial torque and overpull values/trends and calculates that differential sticking has a low probability. This way, the coefficient of filter cake quality may be reduced and hence HCM is reduced, such as to a value of 40. The auto-tune may determine relationships or correlations between coefficients of parameters A, B, C, D, E and F, and may use these determined relationships to calculate changes to the coefficients as drilling operations proceed.

At 50, an HCF plot such as shown in FIG. 5 may be generated. At 52, variance of the HCF curves in the HCF plot may be analyzed on a formation-basis level using both offset wellbore data (if available) and current well measurement data. At 54, if there are multiple HCF points/trends and/or HCM logic over any selected depth interval, the plots may be analyzed and any alarm indicators or corrective action recommendations are calculated if forecast values fall outside the selected safe range.

All of the foregoing at 46, 48, 50, 52 and 54 may be entered into a logic decision, shown at 55. Outputs of the logic decision 55 may include, at 56, if any of the parameters' real-time values or forecast values at a preselected number of segments or stands ahead of the current drill bit position (using trends to estimate) is above a first selected threshold, a low importance alert with specific instructions/recommendations to the specific incidence may be displayed to the user. An example of such alert is explained above with reference to FIG. 6.

At 58, if any of the parameters real-time or forecast value (using trends to estimate) is above a second selected threshold, a high importance alert with specific instructions/recommendations may be displayed to the user. Examples of such alerts are explained above with reference to FIGS. 7 and 8. At 60, the foregoing alerts may, if the data are available, be checked against offset wellbore information to determine thresholds for the alerts and where caution needs to be particularly exercised before proceeding with drilling operations. Offset wellbore data in the present context may include the historical data obtained from offset wellbores. HCM compares the offset information (coefficients, estimations and trends) with the current wellbore data to detect any possible well pressure control or possible pipe sticking occurrence and generate alarms and/or corrective action displays to the user accordingly. The HCM program, as previously explained, may be used for automated machine control of the drilling and measurement system, e.g., as shown in FIG. 1. See, for example, U.S. Pat. No. 7,059,427 issued to Power et al. and U.S. Pat. No. 7,878,254 issued to Abdollahi et al. for example apparatus for automated control of selected parts of the drilling and measurement system.

FIG. 11 depicts an example computing system 100 in accordance with some embodiments. The computing system 100 may be an individual computer system 101A or an arrangement of distributed computer systems. The computer system 101A may include one or more analysis modules 102 that may be configured to perform various tasks according to some embodiments, such as the tasks depicted in FIG. 10. To perform these various tasks, analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be on the well drilling location, while in communication with one or more computer systems such as 101C and/or 101D that may be located in one or more data centers on shore, aboard ships, and/or located in varying countries on different continents).

A processor may include a microprocessor, microcontroller, processor module or subsystem, programmable integrated circuit, programmable gate array, or another control or computing device.

The storage media 106 may be implemented as one or more computer-readable or machine-readable storage media. Note that while in the example embodiment of FIG. 11 the storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 11, and/or computing system 100 may have a different configuration or arrangement of the components depicted in FIG. 11. The various components shown in FIG. 11 may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

Methods in accordance with the present disclosure may assist wellbore operators and drilling unit operators in reducing the possibility of costly, time consuming drilling faults such as the drill string becoming stuck in the wellbore. By providing predicted values of parameters having a relationship to probability of the drill string becoming stuck in the wellbore, the user may take corrective action before conditions in the wellbore approach those likely to result in the drill string becoming stuck in the wellbore.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for monitoring condition of a wellbore, comprising:

generating a model of wellbore conditions for a wellbore being drilled or to be drilled by a drill system that includes a drill string, wherein the model is based at least in part on filter cake quality, initial peak torque on startup of rotation of the drill string, overpull, or a combination thereof:

initializing in a computer a value of a hole condition factor (HCF) based on values for a plurality of parameters having a relationship to likelihood of the drill string of the drilling system becoming stuck in a wellbore;

during drilling operations, measuring at least one drilling parameter having a determinable relationship to the HCF using a measuring device of the drilling system;

in the computer, recalculating the value of the HCF using the at least one measured drilling parameter, wherein recalculating the HCF comprises:

determining coefficients each corresponding to a respective one of the plurality of parameters based on one or more characteristics of the wellbore, coefficients for an offset wellbore, or both, wherein the coefficients are representative of a correlation between the respective parameters;

determining the plurality of parameters, wherein least one of the parameters is determined based on a difference between a measured value of the at least one measured drilling parameter and a theoretical value calculated for the at least one measured drilling parameter; and multiplying the plurality of parameters by the corresponding coefficients to generate factors; and combining the factors to generate the HCF;

adjusting the model based on the recalculated HCF;

displaying at least a portion of the model after adjusting the model;

determining a corrective action to take in the drilling system based on the recalculated value of the HCF to avoid a drilling hazard; and adjusting the drilling system to implement the corrective action.

2. The method of claim 1 further comprising:

determining the corrective action based on the plurality of parameters when the value of the HFC exceeds a selected threshold; and displaying the corrective action when the value of the HCF exceeds the selected threshold, wherein the corrective action includes an indication of a drilling parameter to adjust in the drilling system.

3. The method of claim 2 wherein the selected threshold is determined using measurements made in at least one other wellbore.

4. The method of claim 1 further comprising identifying trends in the recalculated values of HCF, forecasting values of HCF for a selected distance along the wellbore from a current position of a drill string in the wellbore and displaying at least one of an alarm and the corrective action when any of the forecast values of HCF exceeds the selected threshold.

5. The method of claim 1 wherein the plurality of parameters are calculated based on differences between measured values and theoretically calculated values of at least one of drag and torque, equivalent circulating density or equivalent static density of a drilling fluid, pumping pressure of the drilling fluid, a hole cleaning index, a filter cake quality index and a vibration parameter.

6. The method of claim 5 wherein at least one of the plurality of parameters is calculated based in part on drag and torque, and wherein the drag and torque are determined using measured weight of a drill string and measured torque applied to the drill string.

7. The method of claim 5 wherein at least one of the plurality of parameters is calculated based in part on the equivalent circulating density, and wherein the equivalent circulating density is determined using a density of the drilling fluid and a pressure factor related to flow rate of the drilling fluid into the wellbore.

8. The method of claim 5 wherein at least one of the plurality of parameters is calculated based in part on the hole cleaning index, and wherein the hole cleaning index is determined by combining analytical modeling and historical analysis of cuttings transport data.

9. The method of claim 5 wherein at least one of the plurality of parameters is calculated based in part on the filter cake quality index, and wherein the filter cake quality index is determined by making measurements of properties of the drilling fluid using a predetermined test procedure.

10. The method of claim 5 wherein at least one of the plurality of parameters is calculated based in part on the vibration factor, and wherein the vibration factor is determined using a weight applied to a drill bit on a drill string and a torque applied to the drill string at the surface.

11. The method of claim 5 wherein at least one of the plurality of parameters is calculated based in part on a tortuosity index determined by estimating a deviation from a well path using directional surveys.

12. The method of claim 5 wherein a sum of the coefficients is set to unity, and wherein the corresponding parameters comprise the drag and torque, the equivalent circulating density or equivalent static density of the drilling fluid, the pumping pressure of the drilling fluid, the hole cleaning index, the filter cake quality index and the vibration parameter.

13. The method of claim 12 wherein a value of at least one of the corresponding parameters is not present in the calculation, and the sum of the coefficients of the corresponding parameters having values that are present is set to unity.

14. The method of claim 1 wherein a sum of the coefficients is set to unity.

15. A system for monitoring condition of a wellbore, comprising:

a computer having initialized therein a value of a hole condition factor (HCF) based on values for a plurality of parameters having a relationship to likelihood of a drill string becoming stuck in a wellbore;

at least one sensor for measuring at least one drilling parameter having a determinable relationship to the HCF, the at least one sensor in signal communication with the computer, wherein the computer is programmed to perform operations, the operations comprising:

generating a model of a wellbore conditions for a wellbore being drilled or to be drilled by a drill system that includes the drill string, wherein the model is based at least in part on filter cake quality, initial peak torque on startup of rotation of the drill string, overpull, or a combination thereof;

recalculating the value of the HCF using the at least one measured drilling parameter, wherein recalculating the HCF comprises:

determining coefficients each corresponding to a respective one of the plurality of parameters based on one or more characteristics of the wellbore, coefficients for an offset wellbore, or both, wherein the coefficients are representative of a correlation between the respective parameters;

determining the plurality of parameters, wherein least one of the parameters is determined based on a difference between a measured value of the at least one measured drilling parameter and a theoretical value calculated for the at least one measured drilling parameter;

multiplying the plurality of parameters by the corresponding coefficients to generate factors; and combining the factors to generate the HCF;

adjusting the model based on the recalculated HCF;

displaying at least a portion of the model after adjusting the model;

determining, by operation of the computer, a corrective action to take in the drilling system based on a value of the HCF to avoid a drilling hazard; and adjusting, by operation of the computer, the drilling system to implement the corrective action; and a display in signal communication with the computer, wherein the computer is programmed to operate the display to show an alarm when the value of the HCF exceeds a selected threshold.

16. The system of claim 15 wherein the computer is programmed to:

determine the corrective action based on the plurality of parameters when the value of the HFC exceeds the selected threshold, wherein the corrective action includes an indication of a drilling parameter to adjust in the drilling system; and operate the display to show the corrective action.

17. The system of claim 15 wherein the selected threshold is determined using measurements made in at least one other wellbore.

18. The system of claim 16 wherein the alarm comprises a first level alarm when the selected threshold is a first value above a safe limit.

19. The system of claim 18 wherein the alarm comprises a second level alarm when the selected threshold is a second value above the safe limit larger than the first value.

20. The system of claim 15 wherein the computer is programmed to identify trends in the recalculated values of HCF, the computer programmed to forecast values of HCF for a selected distance along the wellbore from a current position of a drill string in the wellbore, the computer programmed to operate the display to show at least one of an alarm and a corrective action when any of the forecast values of HCF exceeds a selected threshold.

21. The system of claim 15 further comprising a sensor for measuring at least one of axial loading on a drill string, torque applied to the drill string, drilling fluid pressure applied to the drill string and wherein the computer is programmed to accept as input a plurality of parameters to calculate the HCF, wherein the plurality of parameters comprise differences between measured values and theoretically calculated values of at least one of drag and torque, equivalent circulating density or equivalent static density of a drilling fluid, pumping pressure of the drilling fluid, a hole cleaning index, a filter cake quality index and a vibration parameter.

22. The system of claim 21 wherein the drag and torque are determined using sensors for measuring weight of the drill string and torque applied to the drill string.

23. The system of claim 21 wherein the equivalent circulating density is calculated using a density of the drilling fluid and a pressure factor related to measurements from a sensor in signal communication with the computer and having a signal output corresponding to a flow rate of the drilling fluid into the wellbore.

24. The system of claim 21 wherein the hole cleaning index is determined by observation of characteristics of the drilling fluid.

25. The system of claim 21 wherein the filter cake quality index is determined by making measurements of properties of the drilling fluid using a predetermined test procedure.

26. The system of claim 21 wherein the vibration factor is determined using measurements from a sensor in signal communication with the computer and having a signal output corresponding to a weight applied to a drill bit on a drill string and using measurements from a sensor in signal communication with the computer and having a signal output corresponding to a torque applied to the drill string at the surface.

27. The system of claim 21 wherein a sum of the coefficients is set to unity, and wherein the corresponding parameters comprise measurements of sensors in signal communication with the computer, the sensor having signal outputs corresponding to the drag and torque, the equivalent circulating density or equivalent static density of the drilling fluid, the pumping pressure of the drilling fluid, the hole cleaning index, the filter cake quality index and the vibration parameter.

28. The system of claim 27 wherein the computer is programmed such that a value of at least one of the corresponding parameters is not present in calculation, and the sum of the coefficients of the corresponding parameters having a value that is present is set to unity.

29. The system of claim 15 wherein the corresponding parameters each being a signal output by a sensor in signal communication with the computer.

30. The method of claim 2 wherein adjusting comprises automatically adjusting the drilling system to implement the corrective action.

31. The method of claim 1 further comprising displaying an alarm when the value of the HCF exceeds a selected threshold.

32. The system of claim 20 wherein the alarm comprises first level alarm when the selected threshold is a first value above a safe limit.

33. The system of claim 32 wherein the alarm comprises a second level alarm when the selected threshold is a second value above the safe limit larger than the first value.

* * * * *